US008582790B2

(12) United States Patent
Knox et al.

(10) Patent No.: US 8,582,790 B2
(45) Date of Patent: Nov. 12, 2013

(54) HEARING AID AND COMPUTING DEVICE FOR PROVIDING AUDIO LABELS

(75) Inventors: John Michael Page Knox, Austin, TX (US); David Matthew Landry, Austin, TX (US); Samir Ibrahim, Silver Spring, MD (US); Andrew Lawrence Eisenberg, Austin, TX (US)

(73) Assignee: Audiotoniq, Inc., Austin, TX (US)

( * ) Notice: Subject to any disclaimer, the term of this patent is extended or adjusted under 35 U.S.C. 154(b) by 187 days.

(21) Appl. No.: 13/023,155

(22) Filed: Feb. 8, 2011

(65) Prior Publication Data

US 2011/0200214 A1 Aug. 18, 2011

Related U.S. Application Data

(60) Provisional application No. 61/304,257, filed on Feb. 12, 2010.

(51) Int. Cl.
*H04R 25/00* (2006.01)

(52) U.S. Cl.
USPC ..... 381/314; 381/60; 381/312

(58) Field of Classification Search
USPC ..... 381/60, 312, 314–316, 320
See application file for complete search history.

(56) References Cited

U.S. PATENT DOCUMENTS

| | | | | |
|---|---|---|---|---|
| 4,689,820 | A * | 8/1987 | Kopke et al. | 381/315 |
| 5,636,285 | A | 6/1997 | Sauer | |
| 5,923,764 | A * | 7/1999 | Shennib | 381/60 |
| 6,738,485 | B1 * | 5/2004 | Boesen | 381/312 |
| 6,748,089 | B1 | 6/2004 | Harris et al. | |
| 7,149,319 | B2 | 12/2006 | Roeck | |
| 7,961,898 | B2 * | 6/2011 | Van den Heuvel | 381/60 |

* cited by examiner

*Primary Examiner* — Suhan Ni
(74) *Attorney, Agent, or Firm* — Lee & Hayes, PLLC

(57) ABSTRACT

A hearing aid includes a microphone to convert audible sounds into sound-related electrical signals and a memory configured to store a plurality of hearing aid profiles. Each hearing aid profile has an associated audio label. The hearing aid further includes a processor coupled to the microphone and to the memory and configured to select one of the plurality of hearing aid profiles. The processor applies the one of the plurality of hearing aid profiles to the sound-related electrical signals to produce a shaped output signal to compensate for a hearing impairment of a user. The processor is configured to insert the associated audio label into the shaped output signal. The hearing aid also includes a speaker coupled to the processor and configured to convert the shaped output signal into an audible sound.

5 Claims, 5 Drawing Sheets

HEARING AID AND COMPUTING DEVICE FOR PROVIDING AUDIO LABELS

CROSS-REFERENCE TO RELATED APPLICATION(S)

This application is a non-provisional of and claims priority to U.S. Provisional Patent Application No. 61/304,257 filed on Feb. 12, 2010 and entitled "Hearing Aid Adapted to Provide Audio Labels," which is incorporated herein by reference in its entirety.

FIELD

This disclosure relates generally to hearing aids, and more particularly to hearing aids configured to provide audio mode labels, including audible updates, to the user.

BACKGROUND

Hearing deficiencies can range from partial hearing impairment to complete hearing loss. Often, an individual's hearing ability varies across the range of audible sound frequencies, and many individuals have hearing impairment with respect to only select acoustic frequencies. For example, an individual's hearing loss may be greater at higher frequencies than at lower frequencies.

Hearing aids have been developed to compensate for hearing losses in individuals. In some instances, the individual's hearing loss can vary across acoustic frequencies. Conventionally, hearing aids range from ear pieces configured to amplify sounds to hearing devices offering a couple of adjustable parameters, such as volume or tone, often can be easily adjusted, and many hearing aids allow for the individual users to adjust these parameters.

However, hearing aids typically apply hearing aid profiles that utilize a variety of parameters and response characteristics, including signal amplitude and gain characteristics, attenuation, and other factors. Unfortunately, many of the parameters associated with signal processing algorithms used in such hearing aids are not adjustable and often the equations themselves cannot be changed without specialized equipment. Instead, a hearing health professional typically takes measurements using calibrated and specialized equipment to assess an individual's hearing capabilities in a variety of sound environments, and then adjusts the hearing aid based on the calibrated measurements. Subsequent adjustments to the hearing aid can require a second exam and further calibration by the hearing health professional, which can be costly and time intensive.

In some instances, the hearing health professional may create multiple hearing profiles for the user for use in different sound environments. Unfortunately, merely providing stored hearing profiles to the user often leaves the user with a subpar hearing experience. In higher end (higher cost) hearing aid models where logic within the hearing aid selects between the stored profiles, the hearing aid may have insufficient processing power to characterize the acoustic environment effectively in order to make an appropriate selection. Since robust processors consume significant battery power, such devices sacrifice processing power for increased battery life. Accordingly, hearing aid manufacturers often choose lower end and lower cost processors, which consume less power but which also have less processing power.

While it is possible that a stored hearing profile accurately reflects the user's acoustic environment, the user may have no indication that it should be applied. Thus, even if the user could select a better profile, the user may not know how to identify and select the better profile.

BRIEF DESCRIPTION OF THE DRAWINGS

In the following description, the use of the same reference numerals in different drawings indicates similar or identical items.

DETAILED DESCRIPTION OF ILLUSTRATIVE EMBODIMENTS

Embodiments of systems and methods are described below for providing an audio label. In an example, a system includes a hearing aid and a computing device configured to communicate with one another. One or both of the hearing aid and the computing device may be configured to update (or replace) a hearing aid profile in use by the hearing aid and to provide an audio label (either through a speaker of the computing device or through the hearing aid) to notify the user audibly of the change.

The speaker reproduces the audio label to provide an audible signal, informing the user when hearing aid profile adjustments occur. Further, the audible signal informs the user so that the user can learn the names of profiles that work best in particular environments, enabling the user to select the profile the next time the user enters the environment. By enabling such user selection, the update time can be reduced because the user can initiate the update as desired, reducing processing time and reducing processing-related power consumption, thereby extending the battery life of the hearing aid.

In some embodiments, the computing device provides an audio menu to the user for user selection of a desired hearing aid profile. By providing audible feedback to the user and/or by providing an audio menu to the user, the user can become familiar with the available hearing aid profiles and readily identify a desired profile. This familiarity allows the user to take control over his or her acoustic experience, enhancing the user's perception of the hearing aid and allowing for a more pleasant and better tuned hearing experience. An example of an embodiment of a hearing aid system is described below with respect to FIG. 1.

Figure 1:
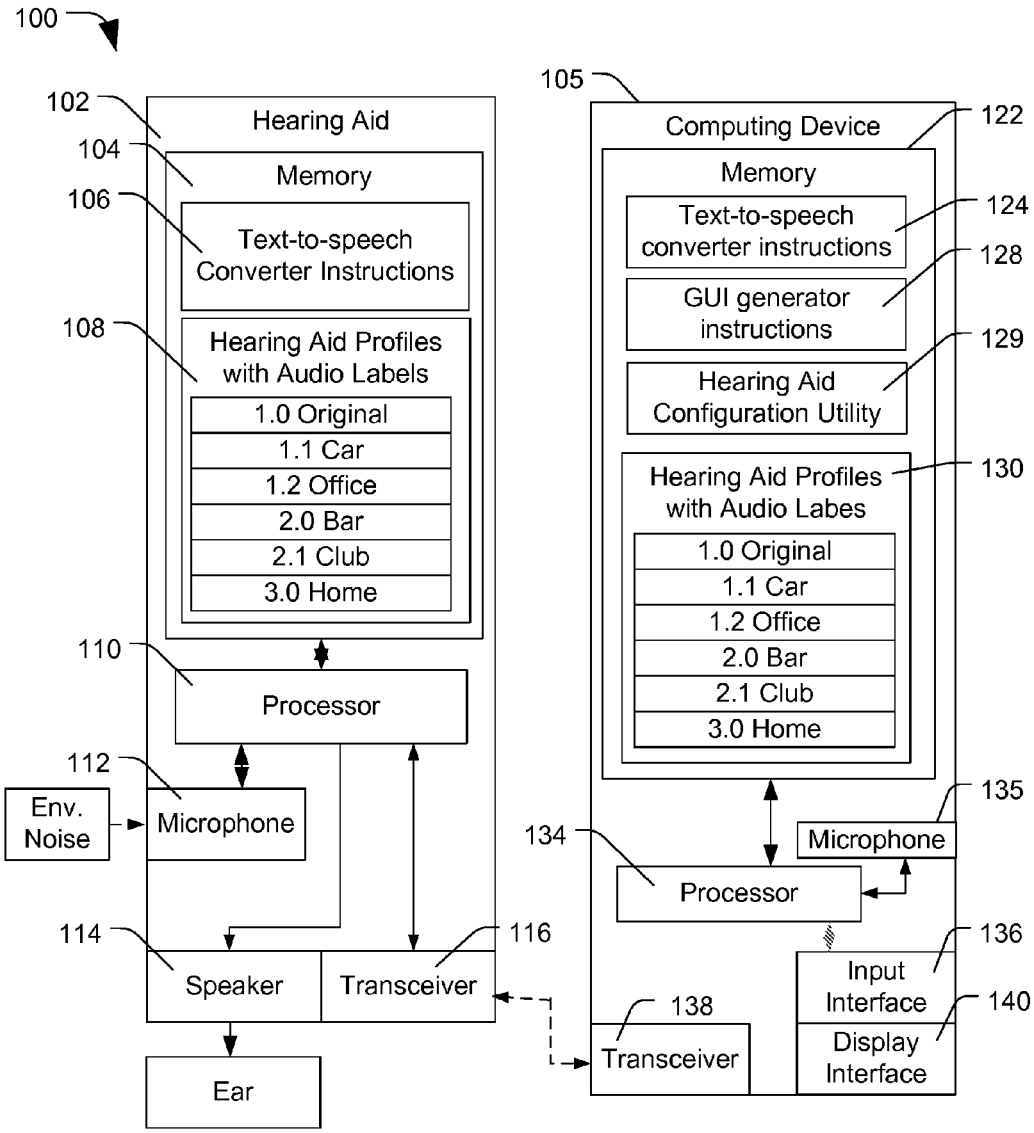
FIG. 1 is a block diagram of an embodiment of a hearing aid system for providing an audio label speech.

FIG. 1 is a block diagram an embodiment of a system 100 including a hearing aid 102 adapted to communicate wirelessly with a computing device 105. Hearing aid 102 includes a transceiver device 116 that is configured to communicate with computing device 105 through a wireless communication channel. Transceiver 116 is a radio frequency transceiver configured to send and receive radio frequency signals, such as short range wireless signals, including Bluetooth® protocol signals, IEEE 802.11 family protocol signals, or other standard or proprietary wireless protocol signals. In some instances, the wireless communication channel can be a Bluetooth® communication channel.

Hearing aid 102 also includes a signal processor 110 coupled to the transceiver 116 and to a memory device 104. Memory device 104 stores processor executable instructions, such as text-to-speech converter instructions 106 and one or more hearing aid profiles with audio labels 108. The one or more hearing aid profiles with audio labels 108 can also include associated text labels. In one example, each hearing aid profile includes an associated audio label and an associated text label. In an alternative embodiment, each hearing aid profile includes an associated text label which can be converted into an audio label during operation by processor 110 using text-to-speech converter instructions 106.

Hearing aid 102 further includes a microphone 112 coupled to processor 1110 and configured to receive environmental noise or sounds and to convert the sounds into electrical signals. Processor 110 processes the electrical signals according to a current hearing aid profile to produce a modulated (shaped) output signal that is provided to a speaker 114, which is configured to reproduce the modulated output signal as an audible sound at or within an ear canal of the user. The modulated (shaped) represents an output signal that is customized to compensate for the user's particular hearing deficiencies.

Computing device 105 is a personal digital assistant (PDA), smart phone, portable computer, tablet computer, or other computing device adapted to send and receive radio frequency signals according to any protocol compatible with hearing aid 102. One representative embodiment of computing device 105 includes the Apple iPhone®, which is commercially available from Apple, Inc. of Cupertino, Calif. Another representative embodiment of computing device 105 is the Blackberry® phone, available from Research In Motion Limited of Waterloo, Ontario. Other types of data processing devices with short-range wireless capabilities can also be used.

Computing device 105 includes a processor 134 coupled to a memory 122, a transceiver 138, and a microphone 135. Computing device 105 also includes a display interface 140 to display information to a user and includes an input interface 136 to receive user input. Display interface 140 and input interface 136 are coupled to processor 134. In some embodiments, a touch screen display may be used, in which case display interface 140 and input interface 138 are combined.

Memory 122 stores a plurality of instructions that are executable by processor 134, including graphical user interface (GUI) generator instructions 128 and text-to-speech instructions 124. When executed by processor 134, GUI generator instructions 128 cause the processor 134 to produce a user interface for display to the user via the display interface 140, which may be a liquid crystal display (LCD) or other display device or which may be coupled to a display device. Memory 122 also stores a plurality of hearing aid profiles 130 with associated text labels and/or audio labels. Processor 134 may execute the text-to-audio instructions 124 to convert a selected one of the associated text labels into an audio label. Further, memory 122 may include a hearing aid configuration utility 129 that, when executed by processor 134, operates in conjunction with the GUI generator instructions 128 to provide a user interface with user-selectable options for allowing a user to select and/or edit a hearing aid profile and to cause the hearing aid profile to be sent to hearing aid 102.

As mentioned above, both hearing aid 102 and computing device 105 include a memory (memory 104 and memory 122, respectively) to store hearing aid profiles with labels. As used herein, the term "hearing aid profile" refers to a collection of acoustic configuration settings, which are used by processor 110 within hearing aid 102 to shape acoustic signals to compensate for the user's hearing impairment and/or to filter other noises. Each of the hearing aid profiles 108 and 130 are based on the user's hearing characteristics and includes one or more parameters designed to compensate for the user's hearing loss or to otherwise shape the sound received by microphone 112 for reproduction by speaker 114 for the user. Each hearing aid profile includes one or more parameters to adjust and/or filter sounds to produce a modulated output signal that may be designed to compensate the user's hearing deficit in a particular acoustic environment.

Computing device 105 can be used to adjust selected parameters of a selected hearing aid profile to customize the hearing aid profile. In an example, computing device 105 provides a graphical user interface including one or more user-selectable elements for selecting and/or modifying a hearing aid profile to display interface 140. Computing device 105 may receive user inputs corresponding to the one or more user-selectable elements and may adjust the sound shaping and the response characteristics of hearing aid profile in response to the user inputs. Computing device 105 transmits the customized hearing aid profile to hearing aid 102. Once received, signal processor 110 can apply the customized hearing aid profile to a sound-related signal to compensate for hearing deficits of the user or to otherwise enhance the sound-related signals, thereby adjusting the sound shaping and response characteristics of hearing aid 102. In an example, such parameters can include signal amplitude and gain characteristics, signal processing algorithms, frequency response characteristics, coefficients associated with one or more signal processing algorithms, or any combination thereof.

Each hearing aid profile of the hearing aid profiles 108 and 130 has a unique label, which can be provided by the user or generated automatically. In an example, the user can create a customized hearing aid profile for a particular acoustic environment, such as the office or the home, and assigns a title or label to the customized hearing aid profile. Such labels can be converted into an audio label using text-to-speech converter instructions 124 in computing device 105 or can be converted (on-the-fly) by processor 110 using text-to-speech converter instructions 106. The customized hearing aid profile can be stored, together with the title and optionally the audio label, in memory 122 and/or in memory 104.

Alternatively, once the customized hearing aid profile is created and a title is assigned by the user, the user can generate an audio label either by recording an audio label (such as a spoken description) or by using the text to audio converter, which will take their entered text title and convert it into an audio label.

Figure 2:
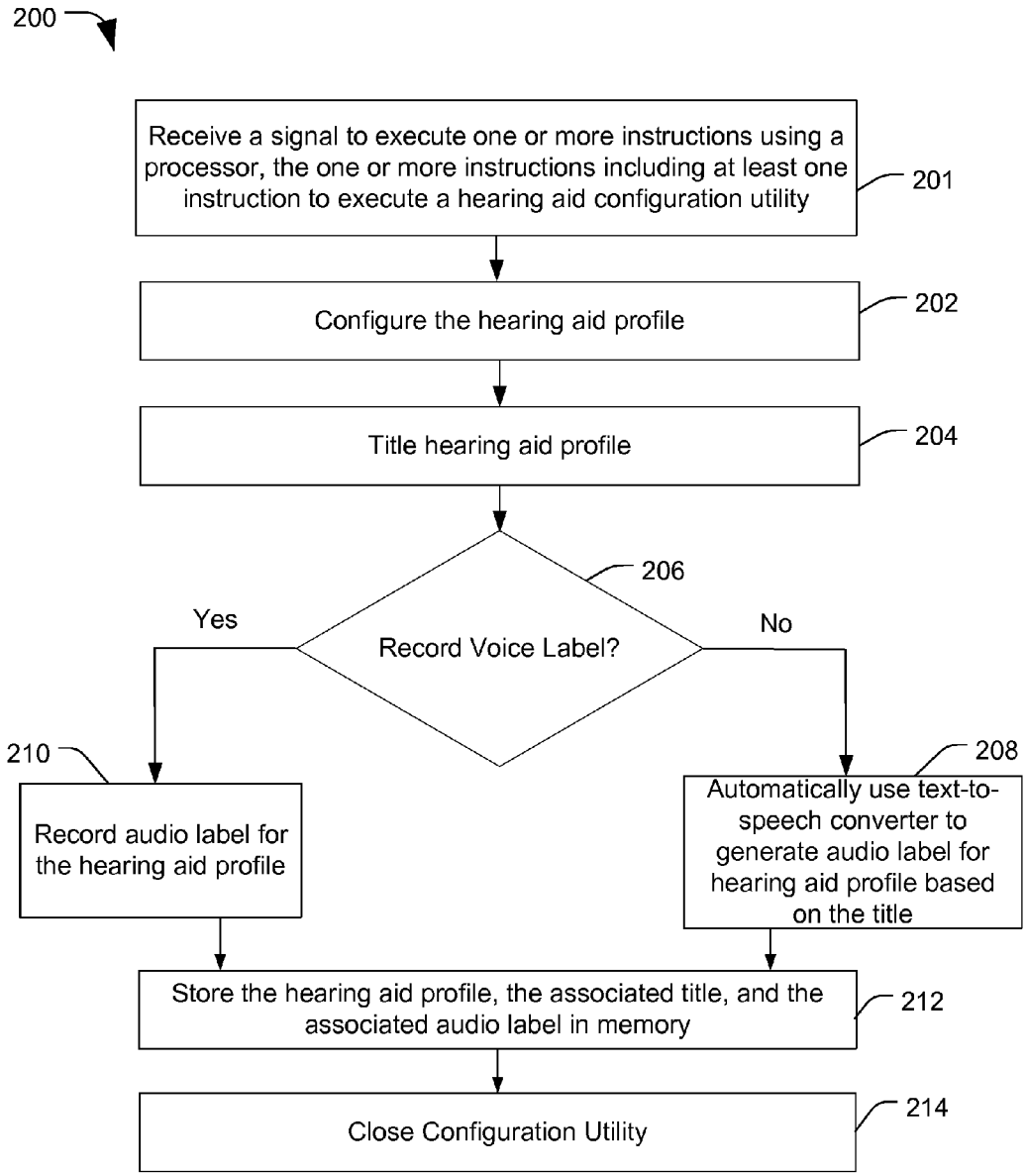
FIG. 2 is a flow diagram of an embodiment of a method for creating an audio label for a hearing aid profile.

FIG. 2 is a flow diagram of method 200 generating a hearing aid profile with audio label. At 201, computing device 105 receives a signal to execute one or more instructions using on processor 134. The one or more instructions including at least one instruction to execute a hearing aid configuration utility 129. The signal may be generated by a user selection of an application icon or selectable element in a GUI presented on display 140. Alternatively, the signal may correspond to an alert from hearing aid 102. Hearing aid configuration utility 129 causes processor 134 to execute GUI generating instructions 128 to display a GUI on display interface 140. Hearing aid configuration utility 129 may also include a set of user notification instructions, which, when executed by processor 134, generates a "GUI ready" notification to indicate to the user that the configuration utility GUI is ready for user input. The notification may take the form of a tone or an audio file saved in either memory 122 or 104, such that the notification can be played by hearing aid 102 using speaker 114. If the notification is stored in memory 122 on computing device 105, the notification can be transmitted from computing device 105 to hearing aid 102 through transceivers 138 and 116 respectively. Audio notification messages, for example, may include brief audio clips, such as "Configuration Utility Ready" or "User Input Required".

Advancing to 202, the hearing aid profile is configured. In an example, the user may view the hearing aid configuration utility GUI on display interface 140 and may access input interface 136 to interact with user-selectable elements and inputs of the GUI to create a new hearing aid profile or to edit an existing hearing aid profile. If the user chooses to edit or reconfigure an existing hearing aid profile, the user may save the revised profile as a new hearing aid profile or overwrite the existing one. In an embodiment, processor 134 of computing device 105 executes instructions to selectively update hearing aid profiles. For example, processor 134 may execute instructions including applying one or more sound-shaping parameters based on the user's hearing profile to a sound sample generated from the acoustic environment to generate a new hearing aid profile.

Once the hearing aid profile is configured, the method proceeds to 204 and a title is created for the hearing aid profile. In an example, the user creates a title for the hearing aid profile by entering the title into a user data input field via input interface 136. Computing device 105 may include instructions to automatically generate a title for the hearing aid profile. In one example, the title can be generated automatically in a sequential order. Alternatively, processor 134 may execute instructions to provide a title input on a GUI on display interface 140 for receiving a title as user data from input interface 136.

Proceeding to 206, the user decides whether to record a voice label for the hearing aid profile by selecting an option within the GUI to record a voice label. For example, the GUI may include a button or clickable link that appears on display interface 140 and that is selectable via input interface 136 to initiate recording. If (at 206) the user chooses not to record an audio label, the method 200 advances to 208 and processor 134 executes text-to-speech converter instructions 124 to convert the text label (title) into an audio label. The resulting audio label could be a synthesized voice, for example. Alternatively, the resulting audio label can be generated using recordings of the user's voice pattern. The method 200 continues to 212 and the hearing aid profile, the associated title, and the associated audio label are stored in memory. Advancing to 214, the configuration utility is closed.

Returning to 206, if the user chooses to record a voice label, the method 200 advances to 210 and an audio label is recorded for the hearing aid profile. In an example, computing device 105 will use microphone 135 to record a voice label spoken by the user. In the alternative, computing device 105 may send a signal to hearing aid 102 through transceivers 138 and 116 instructing processor 110 to execute instructions to record an audio label using microphone 112.

The recorded audio label or the generated audio label may be stored in memory 122 and/or in memory 104. In one embodiment, processor 110 includes logic to recognize the user's voice to create the audio label, which can be sent to computing device 105 for storage in memory 122 with the hearing aid profile. Advancing to 212, the hearing aid profile, the title, and the audio label are stored in memory. Continuing to 214, the configuration utility is closed.

While method 200 is described as operating on computing device 105, the method 200 can be adapted for execution by hearing aid 102. For example, hearing aid 102 can be adapted to include logic to record audio files and to create hearing aid profiles for storage in memory 104. By utilizing processor 134 and memory 122 in computing device 105, hearing aid profiles and associated audio labels can be stored in memory 122 and generated by processor 134, allowing hearing aid 102 and its components to remain small.

While method 200 describes generation of an audio label for a hearing aid profile, the resulting audio label is played in conjunction with its associated hearing aid profile. An example of a method of utilizing the audio label is described below with respect to FIG. 3.

Figure 3:
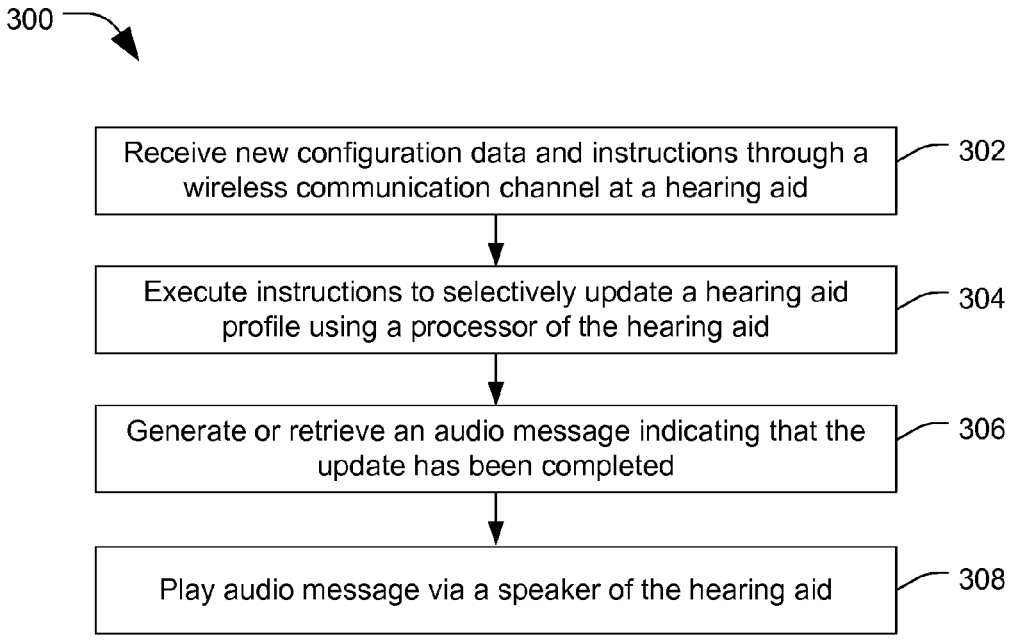
FIG. 3 is a flow diagram of an embodiment of a method of notifying the user of a hearing aid profile update using an audio label for a hearing aid profile.

FIG. 3 is a flow diagram of an embodiment of a method 300 of notifying the user of a hearing aid profile update using an audio label for a hearing aid profile. At 302, hearing aid 102 receives new configuration data and instructions through a communication channel. In an example, hearing aid 102 receives an update data packet at transceiver 116 from computing device 105 through the communication channel. The packet may include header information as well as payload data, including at least one audio label, the new configuration data (such as a new hearing aid profile), and instructions. Such instructions can include commands or other instructions executable by processor 110 of hearing aid 102. Further, such instructions can identify instructions already stored in memory 104 of hearing aid 102. Alternatively, the packet may include an audio label, a hearing aid profile, instructions, or any combination thereof. In one instance, the packet may include the hearing aid profile and a text label, and hearing aid 102 uses text-to-speech instructions 106 to convert the text label into a audio signal and automatically updates the current hearing aid profile of hearing aid 102 with the hearing aid profile. In still another embodiment, the packet may include a hearing aid profile identifier associated with a hearing aid profile already stored within memory 104 of hearing aid 102.

Advancing to 304, the processor 110 of hearing aid 102 executes instructions to selectively update hearing aid profiles. In an example, the data packet includes instructions for processor 110 to execute an update on the hearing aid configuration settings, which update can include replacing a hearing aid profile in memory 104 of hearing aid 102 with a different hearing aid profile. Alternatively, the update can include updating specific coefficients of the current hearing aid profile. For example, the update can include an adjustment to the internal volume of hearing aid 102, an adjustment to one or more power consumption algorithms or operating modes of hearing aid 102, or other adjustments. The update package or payload may also include either an audio label for replay by speaker 114 of hearing aid 102 or a list of actions for processor 110 to perform to generate an audible message based on a title of the audio label.

Proceeding to 306, an audio message is generated indicating that the update has been completed. In an example, hearing aid 102 contains logic (such as instructions executable by processor 110) designed to take the update data packet including a hearing aid profile audio label and generate an audio message that notifies the user about the modifications processor 110 has completed on hearing aid 102. The audio message may be compiled from the list of actions processor 110 has taken or generated from the audio clips included in the data packet received form computing device 105. In one instance, the packet may include the audio label, and the audio message may include a combination of the actions taken by processor 110 and the audio label. For example, the message may take the form of the audio label followed by a description of actions taken, such as "Bar Profile Activated". Alternatively, the message may identify only the change that was made, such as "Volume Increased", or "Sound Cancelation Activated." in some instances, the audio message may contain more than one configuration change, such as "Volume Increased and Bar Profile Activated." Moving to 308, the audio message is played via speaker 114 of hearing aid 102. The audio message provides feedback to the user that particular changes have been made.

In an alternative embodiment, the change and/or the audio label may be played by a speaker associated with computing device 105, in which case the audio signal is received by microphone 112 of hearing aid 102. The new hearing aid profile (or newly configured hearing aid profile) applied by processor 110 of hearing aid 102 would then operate to shape the environmental sounds received by microphone 112.

In the discussion of the method of FIG. 3, hearing aid 102, by itself or in conjunction with computing device 105, provides an audible alert to the user, notifying the user of a change to the hearing aid profile being applied by hearing aid 102. However, in some instances, it may be desirable to allow the user to select a hearing aid profile from several recommended hearing aid profiles in connection with an audio menu. One possible example of such a scenario is presented below with respect to FIG. 4.

Figure 4:
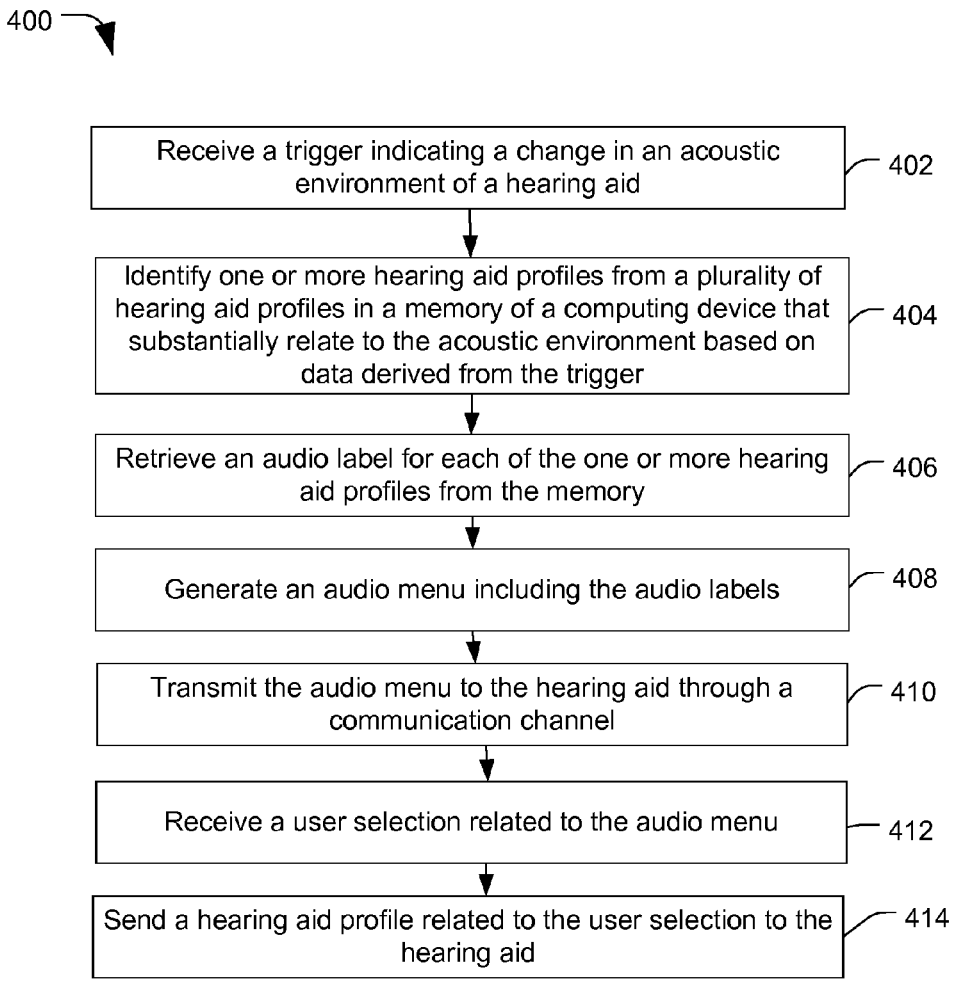
FIG. 4 is a flow diagram of an embodiment of a method of updating a hearing aid profile based on a user response to an audio menu.

FIG. 4 is a flow diagram an embodiment of a method 400 of updating a hearing aid profile based on a user response to an audio menu. At 402, processor 134 of computing device 105 receives a trigger indicating a change in an acoustic environment of a hearing aid, such as hearing aid 102. The trigger can be a message sent by hearing aid 102 to computing device 105 through the communication channel. In an example, the trigger includes an indication that the environmental noise has changed from the sound environment in which the current hearing aid profile was selected. If the change is sufficiently large, it may be desirable to update the hearing aid profile for the new sound environment. In another instance, the trigger may be generated based on instructions operating on processor 134 of computing device 105 that analyze sound samples received from microphone 135. In one particular example, the trigger may be a user-initiated trigger, such as through a voice command, interaction with a user interface on hearing aid 102, or through interaction with input interface 136 of computing device 105. Regardless of the source, the trigger can include data related to the current acoustic environment, data related to a current hearing aid profile setting, other information, or any combination thereof. In one instance, the trigger includes the indication of the change as well as a set of data that computing device 105 uses to execute a hearing aid profile selection procedure, which creates a menu of user-selectable options including suitable hearing aid profiles from which the user can select. Thus, the trigger can be utilized by computing device 105 to determine a suitability for the acoustic environment of other hearing aid profiles 130 within memory 122.

Proceeding to 404, processor 134 identifies one or more hearing aid profiles from the plurality of hearing aid profiles 130 in memory 122 of computing device 105 that substantially relate to the acoustic environment based on data derived from the trigger. Each identified hearing aid profile may be added to a list of possible matches. In one instance, processor 134 may iteratively compare data from the trigger to data stored with the plurality of hearing aid profiles 130 to identify the possible matches. In another instance, processor 134 may selectively apply one or more of the hearing aid profiles 130 to data derived from the trigger to determine possible matches. As used herein, a possible match refers to an identified hearing aid profile that may provide a better acoustic experience for the user than the current hearing aid profile given the particular acoustic environment. In some instance, the "better" hearing aid profile produces audio signals having lower peak amplitudes at selected frequencies relative to the current profile. In other instances, the "better" hearing aid profile includes filters and frequency processing algorithms suitable for the acoustic environment. In some instances, when the current hearing aid profile is better than any of the others for the given acoustic environment, computing device 105 may not identify any hearing aid profiles. In such an instance, the user may elect to access the hearing aid profiles manually through input interface 136 to select a different hearing aid profile and optionally to edit the hearing aid profile for the environment. However, if processor 134 is able to identify one or more hearing aid profiles that are possible matches based on the trigger, processor 134 will assemble the list of identified hearing aid profiles.

Advancing to 406, processor 134 retrieves an audio label for each one of the identified one or more hearing aid profiles from the memory 122. In an embodiment, audio labels for each of the hearing aid profiles are recorded and stored in memory 122 when they are created. In another embodiment, to reduce memory usage, retrieving the audio label includes retrieving a text label associated with the one or more hearing aid profiles and applying a text-to-speech component to convert the text labels into audio labels on the fly.

After the audio labels are retrieved from memory 122, method 400 proceeds to 408 and processor 134 generates an audio menu including the audio labels. The audio menu can include the audio labels as well as instructions for the user to response to the audio menu in order to make a selection. For example, the audio menu may include instructions for the user to interact with user interface 136, such as "press 1 on your cell phone for a first hearing aid profile", "press 2 on your cell phone for a second hearing aid profile", and so on. In a particular example, the audio menu may include the following audio instructions and labels:

"A change in your acoustic environment has been detected and a change in your hearing aid settings is recommended. Please select from the following menu options by interacting with the user interface on your phone:

Press 1 if you are at 'home';

Press 2 if you are at 'work'; or

Press 3 if you are another location.

In the above example, the apostrophes denote the hearing aid profile labels. Further, in the above example, user interaction with the user interface 136 is required to make a selection. However, in an alternative embodiment, interactive voice response instructions may be used to receive voice responses from the user. In such an embodiment, the instructions may instruct the user to "press or say . . . " In such an instance, processor 110 within hearing aid or processor 134 within computing device 105 may convert the user's voice response into text using a speech-to-text converter (not shown).

Continuing to 410, transceiver 138 transmits the audio menu to the hearing aid through a communication channel. The audio menu is transmitted in such a way that hearing aid 102 can play the audio menu to the user. Advancing to 412, computing device 105 receives a user selection related to the audio menu. The selection could be received through the communication channel from hearing aid 102 or directly from the user through input interface 136. As previously mentioned, the selection could take on various forms, including an audible response, a numeric or text entry, or a touch-screen selection. Proceeding to 414, transceiver 138 sends the hearing aid profile related to the user selection to hearing aid 102. Processor 134 may receive a user selection of "five," and send the corresponding hearing aid profile (i.e., the hearing aid profile related to the user selection) to hearing aid 102. Processor 110 of hearing aid 102 may apply the hearing aid profile to shape sound signals within hearing aid 102.

Multiple methods of creating an audio menu of suitable hearing aid profiles and associated user selection options can be utilized by processor 134. The embodiment depicted in FIG. 5 represents one possible method of identifying the one or more hearing aid profiles for generation of such a menu.

Figure 5:
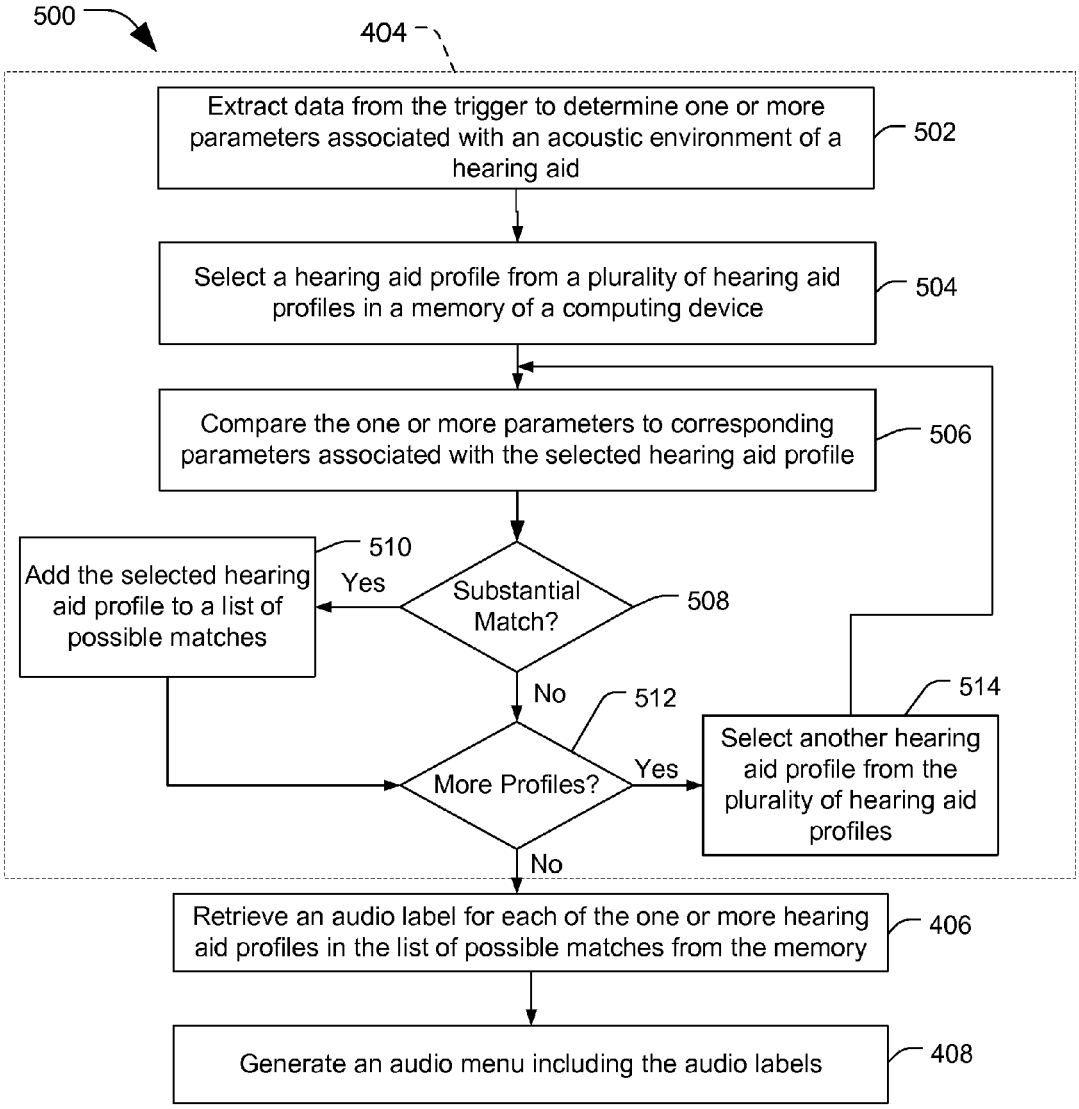
FIG. 5 is a flow diagram of an embodiment of a method of generating an audio menu according to a portion of the method depicted in FIG. 4.

FIG. 5 is a flow diagram of an embodiment of a method 500 of identifying one or more hearing aid profiles according to a portion of the method depicted in FIG. 4, including blocks 404, 406, and 408. At 502, processor 134 extracts data from the trigger to determine one or more parameters associated with an acoustic environment of hearing aid 102. The parameters associated with an acoustic environment may include one or more of frequency differences, frequency ranges, frequency contents, amplitude ranges, amplitude averages, background noise levels, and/or other data, including the current hearing aid profile of hearing aid 102.

Advancing to 504, processor 134 selects a hearing aid profile from a plurality of hearing aid profiles 130 in memory 122 of a computing device 105. Processor 134 may select the hearing aid profile from plurality of hearing aid profiles 130 either in a FIFO (first in first out order), a most recently used order, or a most commonly used order. Alternatively, the trigger may include a memory location, and processor 134 may select the hearing aid profile from a group of likely candidates based on the trigger.

Proceeding to 506, processor 134 compares the one or more parameters to corresponding parameters associated with the selected hearing aid profile to determine if it is suitable for the environment. At 508, if there is a substantial match between the parameters, method 500 advances to 510 and processor 134 adds the selected hearing aid profile to a list of possible matches and proceeds to 512. Returning to 508, if the selected hearing aid profile does not substantially match the parameters, processor 134 will not add the selected hearing aid profile to the list, and the method proceeds directly to 512.

At 512, processor 134 determines if there are more profiles that have not been compared to the trigger parameters. If there are more profiles, the method advances to 514 and processor 134 selects another hearing aid profile from the plurality of hearing aid profiles. The method returns to 506 and the processor 134 compares one or more parameters of the trigger to corresponding parameters associated with the selected hearing aid profile. In this example, processor 134 may cycle through the entire plurality of hearing aid profiles 130 in memory 122 until all profiles have been compared to compile the list.

In an alternative embodiment, processor 134 may be looking fora predetermined number of substantial matches, which may be configured by the user. In this alternative case, processor 134 will continue to cycle through hearing aid profiles 130 to identify suitable hearing aid profiles from plurality of hearing aid profiles 130 until the pre-determined number is reached or until there are no more hearing aid profiles in memory 122. In a third embodiment, processor 134 will only cycle through a predetermined number of hearing aid profiles before stopping. Processor 134 will then only add the substantial matches that are found within the predetermined number of hearing aid profiles to the list.

At 512, if there are no more profiles (whether because the last profile has already been compared, the pre-determined limit has been reached, or some other limit has occurred), the method advances to 406, and an audio label for each of the one or more hearing aid profiles in the list of possible matches is retrieved from memory. In some instances, it may be desirable to limit the list of possible matches to a few, such as three or five. In such a case, the list may be assembled such that the three or five best matches are kept and other possible matches are bumped from the list, so that only the three or five best matches are presented to the user. Continuing to 408, an audio menu is generated that includes the audio labels.

It should be understood that the blocks depicted in FIGS. 2-5 may be arranged in various alternative orders, other blocks may be added, or some blocks may even be omitted. In one variant of method 400, for example, processor 134 may compile the audio menu with the associated hearing aid profiles and transmit the entire package (menu and profiles) to hearing aid 102. In this instance, the selection may be made and the hearing aid profile applied immediately without transmission delay and without further reduce communication between hearing aid 102 and computing device 105. In a variation of the method 500 in FIG. 5, an additional block may be added between block 404 and block 406 to process the list of possible matches to reduce the number of possible matches in the list to a manageable size before retrieving the labels and generating the audio menu.

By providing the user with an audio indication of the hearing aid configuration, the user is made aware of changes in the hearing aid settings, allowing the user to acquire a better understanding of available hearing aid profiles. Further, by presenting the user with an option menu from which he or she may select, the user is permitted to be in partial control of the settings, tuning, and selection process, providing the user with more control of his or her hearing experience. Additionally, by providing the user with opportunities to control the acoustic settings of the hearing aid through such hearing aid profiles, the hearing aid 102 provides the user with the opportunity to have a more finely tuned, better quality, and friendlier hearing experience that is available in conventional hearing aid devices.

In the above-described examples, a single hearing aid is updated and plays an audio label. However, it should be appreciated that many users have two hearing aids, one for each ear. In such an instance, computing device 105 may provide separately accessible audio menus, one for each hearing aid. Further, since the user's hearing impairment in his/her left ear may differ from that of his/her right ear, computing device 105 may independently update a first hearing aid and a second hearing aid. Additionally, when two hearing aids are used, each hearing aid may independently trigger the hearing aid profile adjustment.

In conjunction with the system and methods depicted in FIGS. 1-5 and described above, a hearing aid system is disclosed that includes a hearing aid and a computing device that are configurable to communicate with one another through a communication channel, such as a wireless communication channel. The computing device and the hearing aid are configured to cooperate update the hearing aid with different hearing aid profiles as desired and to audibly notify the user when changes are made to the hearing aid settings by providing an audio alert including an audio label identifying the newly applied hearing aid profile, so that the user is aware of the settings applied to his or her hearing aid. In some instances, a user selection menu may be presented as an audio menu to which the user may respond in order to select a hearing aid profile from a list, thereby placing the user in control of his or her hearing experience. As discussed above, the user input may be received as an audio response or as an input provided via an input interface on the computing device. Based on the user selection, the selected hearing aid profile is provided to the hearing aid so that a processor of the hearing aid can shape sound signals using the selected hearing aid profile.

Although the present invention has been described with reference to preferred embodiments, workers skilled in the art will recognize that changes may be made in form and detail without departing from the scope of the invention.

What is claimed is:

1. A computing device comprising:

a memory configured to store a configuration utility, a plurality of hearing aid profiles, and a respective plurality of audio labels, wherein each audio label is associated with one of the plurality of hearing aid profiles as a title;

an input interface for receiving user selections;

a transceiver configurable to wirelessly communicate with a hearing aid through a communication channel; and a processor coupled to the memory and configured to execute the configuration utility to cause the processor to:

identify one or more of the hearing aid profiles from the plurality of hearing aid profiles substantially related to an acoustic environment associated with a hearing aid by comparing data related to the acoustic environment to settings associated with the plurality of hearing aid profiles;

provide the audio labels associated with each of the identified one or more hearing aid profiles to the hearing aid;

receive a selection of one of the one or more hearing aid profiles at the input interface; and provide the selected hearing aid profile to the hearing aid.

2. The computing device of claim 1, further comprising a speaker configured to receive the audio labels associated with each of the identified one or more hearing aid profiles and to reproduce the audio labels as an audible sound indicating a change of the current hearing aid profile of the hearing aid.

3. The computing device of claim 1, wherein the audio labels associated with each of the identified one or more hearing aid profiles are communicated to the hearing aid through the communication channel for reproduction as an audible sound by the hearing aid.

4. The computing device of claim 1, wherein the audio label comprises a recorded sound file.

5. The computing device of claim 1, wherein the memory includes a text-to-speech converter that, when executed by the processor, causes the processor to convert a text label into the audio label comprising a sound file and to associate the sound file with the selected one of the plurality of hearing aid profiles.

* * * * *